US010216121B2

(12) United States Patent
Uohashi

(10) Patent No.: US 10,216,121 B2
(45) Date of Patent: Feb. 26, 2019

(54) TRANSFER UNIT AND IMAGE FORMING APPARATUS

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 27 days.

(21) Appl. No.: 15/663,904

(22) Filed: Jul. 31, 2017

(65) Prior Publication Data

US 2018/0039208 A1 Feb. 8, 2018

(30) Foreign Application Priority Data

Aug. 8, 2016 (JP) ..... 2016-155487

(51) Int. Cl.
*G03G 15/16* (2006.01)
*G03G 15/00* (2006.01)

(52) U.S. Cl.
CPC ..... *G03G 15/161* (2013.01); *G03G 15/6558* (2013.01)

(58) Field of Classification Search
CPC ..... G03G 15/161
See application file for complete search history.

(56) References Cited

U.S. PATENT DOCUMENTS 7,979,000 B2 7/2011 Sekina et al.
2010/0003051 A1 1/2010 Sekina et al.
2010/0278557 A1* 11/2010 Somemiya ..... G03G 21/1638 399/124
2011/0091238 A1* 4/2011 Nakazawa ..... G03G 15/161 399/110
2012/0099896 A1* 4/2012 Kamano ..... G03G 15/161 399/121
2014/0112690 A1* 4/2014 Deguchi ..... G03G 15/161 399/313

FOREIGN PATENT DOCUMENTS

JP 2010015059 A 1/2010
JP 2010015060 A 1/2010
JP 5100540 B2 12/2012
JP 5157688 B2 3/2013

* cited by examiner

*Primary Examiner* — Sevan A Aydin
(74) *Attorney, Agent, or Firm* — Studebaker & Brackett PC

(57) ABSTRACT

A transfer unit includes a transfer roller, a guide, a holder and a lever. The transfer roller is configured to be pressed against an image carrier to form a transferring nip and to transfer a toner image from the image carrier to a sheet at the transferring nip. The guide is configured to guide the sheet to the transferring nip. The holder is configured to support a rotating shaft of the transfer roller in a rotatable manner and to support the guide. The lever is configured to support the holder in a turnable manner around the rotating shaft so as to press the transfer roller against the image carrier. The guide has an engaged part. The lever has an engagement part which is engaged with the engaged part. An engagement of the engagement part with the engaged part prevents a turning of the guide with respect to the lever.

4 Claims, 7 Drawing Sheets

TRANSFER UNIT AND IMAGE FORMING APPARATUS

INCORPORATION BY REFERENCE

This application is based on and claims the benefit of priority from Japanese Patent application No. 2016-155487 filed on Aug. 8, 2016, which is incorporated by reference in its entirety.

BACKGROUND

The present disclosure relates to a transfer unit which transfers a toner image formed on an image carrier to a sheet and to an image forming apparatus including the transfer unit.

In an image forming apparatus, such as a copying machine and a printer, a toner image formed on an image carrier, such as a photosensitive drum and an intermediate transferring belt, is transferred to a sheet from the image carrier at a transferring nip formed between the image carrier and a transfer member.

The sheet is guided to the transferring nip along a guide. The guide is configured to guide the sheet to the transferring nip with a constant conveying posture. When the sheet is guided with the constant conveying posture, the guide receives a load from the sheet. As the size of the image forming apparatus is reduced in recent years, a curvature of a conveying path of the sheet becomes large. As a result, a stiffness of the sheet has a large effect on the conveying posture. In a case of a sheet having a large rigidity such as a thick paper, the load received by the guide increases because of its strong stiffness.

There is an image forming apparatus provided with a lever which is turned to press the transfer member against the image carrier. The lever is pressed by a turnable conveying unit and then turned to press the transfer member against the image carrier.

An example in which the transfer member is pressed by the lever will be described with reference to FIG. 7. In this example, a transfer roller 101 as the transfer member and the guide 102 are supported by a holder 103. The levers 104 support both end portions of a rotating shaft 101*b* of the transfer roller 101 in a rotatable manner. The lever 104 has a bearing part 108 and a spring receiving part 109. The bearing part 108 and the spring receiving part 109 are located on one side and the other side across the rotating shaft 101*b*. The bearing part 108 is supported by a boss 107 provided on the conveying unit (not shown) in a rotatable manner. The spring receiving part 109 is biased by a coil spring (not shown) provided on the conveying unit.

When the conveying unit is turned, the levers 104 are turned around the bosses 107 and presses the rotating shaft 101*b* of the transfer roller 101 such that the transfer roller 101 is pressed against the intermediate transferring belt 106 to form the transferring nip 111. The holder 103 and the lever 104 respectively have turning stoppers 113 and 114 both of which are engaged with each other to prevent the holder 103 from being turned with respect to the lever 104.

In a case of the example shown in FIG. 7, when the sheet passes through the transferring nip 111, if the sheet has a strong stiffness, the load (refer to a white bulk arrow in FIG. 7) received by the guide 102 from the sheet becomes large, and then a moment which turns the holder 103 around the rotating shaft 101*b* in the counterclockwise direction in FIG. 7 (refer to an arrow in FIG. 7) is generated. Then, depending on a mounting backlash and a deflection of each member, the holder 103 may be turned to displace the guide 102. However, because the holder 103 and the lever 104 respectively have the tuning stoppers 113 and 114, the holder 103 is only turned until the turning stoppers 113 and 114 are engaged with each other.

However, depending on sizes and shapes of the holder 103 and the levers 104, it is necessary to form the turning stoppers 113 and 114 near an axial center of the rotating shaft 101*b*. Then, if the turning stoppers 113 and 114 may have dimension errors, a turning angle of the holder 103 until the tuning stoppers 113 and 114 are engaged with each other becomes large, and thus the holder 103, that is, the guide 102 is considerably displaced. In addition, because the load received by the guide 102 is transferred to the levers 104 through the holder 103, dimension error and rigidity of the holder 103 is also affected on the displacement of the guide 102.

If the guide 102 may be displaced, the conveying posture of the sheet is varied such that it becomes difficult to guide the sheet to the transferring nip 111 stably. As a result, image failure may be occurred. Alternatively, if the guide 102 and the holder 103 may be made using high rigid material in order to withstand the increased load, the size of each member may become large and a material cost may be increased.

SUMMARY

In accordance with an aspect of the present disclosure, a transfer unit includes a transfer roller, a guide, a holder and a lever. The transfer roller is configured to be pressed against an image carrier to form a transferring nip and to transfer a toner image from the image carrier to a sheet at the transferring nip. The guide is configured to guide the sheet to the transferring nip. The holder is configured to support a rotating shaft of the transfer roller in a rotatable manner and to support the guide. The lever is configured to support the holder in a turnable manner around the rotating shaft so as to press the transfer roller against the image carrier. The guide has an engaged part. The lever has an engagement part which is engaged with the engaged part. An engagement of the engagement part with the engaged part prevents a turning of the guide with respect to the lever.

In accordance with an aspect of the present disclosure, an image forming apparatus includes a conveying unit and the above described transfer unit. The conveying unit is supported by an apparatus main body in a tunable manner and configured to form a sheet conveying path with the apparatus main body. The conveying unit has a storage recess in which the transfer unit is stored. The storage recess has a supporting shaft and a biasing member. The supporting shaft supports the lever in a tunable manner. The biasing member is configured to bias the lever in a direction in which the transfer roller is pressed against the image carrier when the conveying unit is turned in a direction in which the conveying path is formed.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, a transfer unit and an image forming apparatus according to one embodiment of the present disclosure will be described.

Figure 1:
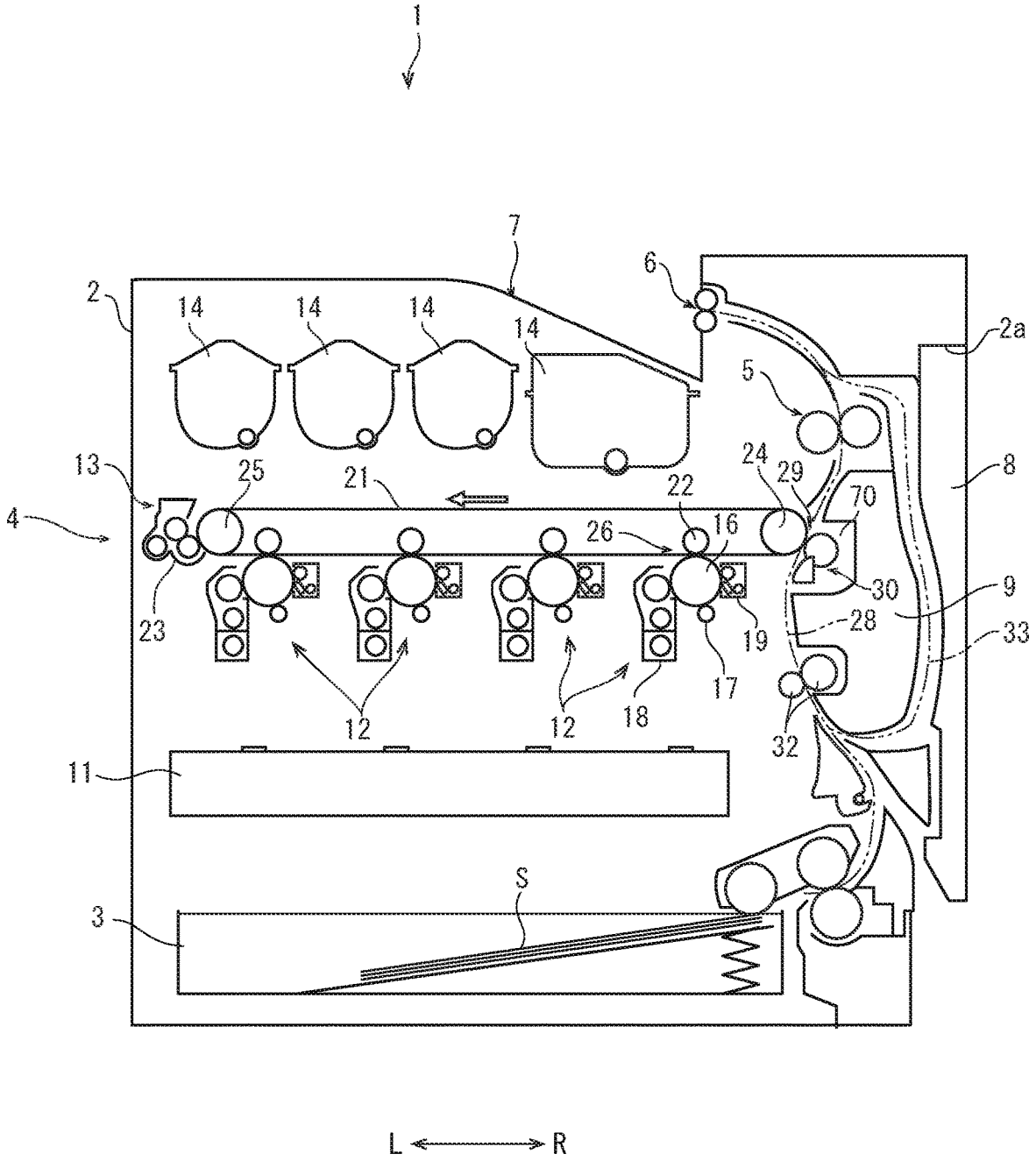
FIG. 1 is a sectional view schematically showing an inner structure of a color printer according to one embodiment of the present disclosure.

With reference to FIG. 1, an entire structure of a color printer 1 as the image forming apparatus will be described. FIG. 1 is a side view schematically showing an inner structure of the color printer 1. In the following description, a near side of a paper plan of FIG. 1 is defined to be a front side of the color printer 1, and a left-right direction is defined based on the direction in which the printer 1 is viewed from the front side. Fr, Rr, L and R shown in each figure respectively show the front, rear, left and right sides of the color printer 1.

An apparatus main body 2 of the color printer 1 includes a sheet feeding cassette 3 in which a sheet S is stored, an image forming part 4 configured to form a full color toner image on the sheet S, a fixing device 5 configured to fix the toner image to the sheet S, a sheet ejection device 6 configured to eject the sheet S having the fixed toner image, an ejected sheet tray 7 configured to receive the ejected sheet S, a cover unit 8 and a conveying unit 9 both of which form a conveying path of the sheet S.

The image forming part 4 includes an exposing device 11, an image forming unit 12 provided for each toner of four colors (yellow, magenta, cyan and black), an intermediate transfer unit 13 disposed above the image forming units 12 and four toner containers 14 each containing the toner of each color.

Each image forming unit 12 includes a photosensitive drum 16 on which an electrostatic latent image is formed, a charger 17 which charges the photosensitive drum 16, a development device 18 which develops the electrostatic latent image formed on the photosensitive drum 16 with the toner supplied from the toner container 14 and a cleaning device 19 which removes the toner remained on a surface of the photosensitive drum 16.

The intermediate transfer unit 13 includes an endless intermediate transferring belt 21 as an image carrier, four primary transferring rollers 22 disposed in a hollow space of the intermediate transferring belt 21 and a belt cleaning device 23. The intermediate transferring belt 21 is supported by a drive roller 24 and a driven roller 25 to be circulated by rotation of the drive roller 24. Each primary transferring roller 22 faces the photosensitive drum 16 via the intermediate transferring belt 21. Between the intermediate transferring belt 21 and the photosensitive drum 16, a primary transferring nip 26 is formed.

The cover unit 8 is supported in an opening 2*a* formed on a right side face of the apparatus main body 2 in a rotatable manner around its lower end. The conveying unit 9 is supported by an inner face of the cover unit 8 in a rotatable manner around its lower end. Between the conveying unit 9 and the apparatus main body 2, the conveying path 28 of the sheet S is formed such that the sheet S is conveyed from the sheet feeding cassette 3 to the sheet ejection device 6 through the image forming part 4 and the fixing device 5. On an inner face (a face facing the conveying path 28) of the conveying unit 9, a secondary transfer unit 30 is supported. The secondary transfer unit 30 is configured to form a secondary transferring nip 29 with the intermediate transferring belt 21. On the conveying path 28, a pair of registration rollers is provided at the upstream side of the secondary transferring nip 29 in the conveying direction. One of the registration rollers 32 is supported by the inner face of the conveying unit 9 in a rotatable manner. Between the cover unit 8 and the conveying unit 9, a conversion path 33 for a duplex printing is formed.

In each image forming unit 12, the photosensitive drum 16 is charged by the charger 17 and then exposed by the exposing device 11 according to an image data. This forms an electrostatic latent image on the photosensitive drum 16. The electrostatic latent image is developed into a toner image by the development device 18. The toner image is transferred to the intermediate transferring belt 21 from the photosensitive drum 16 at the primary transferring nip 26. By transferring the four toner images developed by the four image forming units 12 to the intermediate transferring belt 21, a full color toner image is formed on the intermediate transferring belt 21. The toner remained on each photosensitive drum 16 is removed by the cleaning device 19.

On the other hand, the sheet S fed from the sheet feeding cassette 3 is conveyed along the conveying path 28. Then, the full color toner image formed on the intermediate transferring belt 21 is transferred to the sheet S at the secondary transferring nip 29. The sheet S having the full color toner image is conveyed to the fixing device 5. The fixing device 5 fixes the full color toner image on the sheet S. The sheet S having the fixed full color toner image is ejected on the ejected sheet tray 7 by the sheet ejection device 6.

Figure 2:
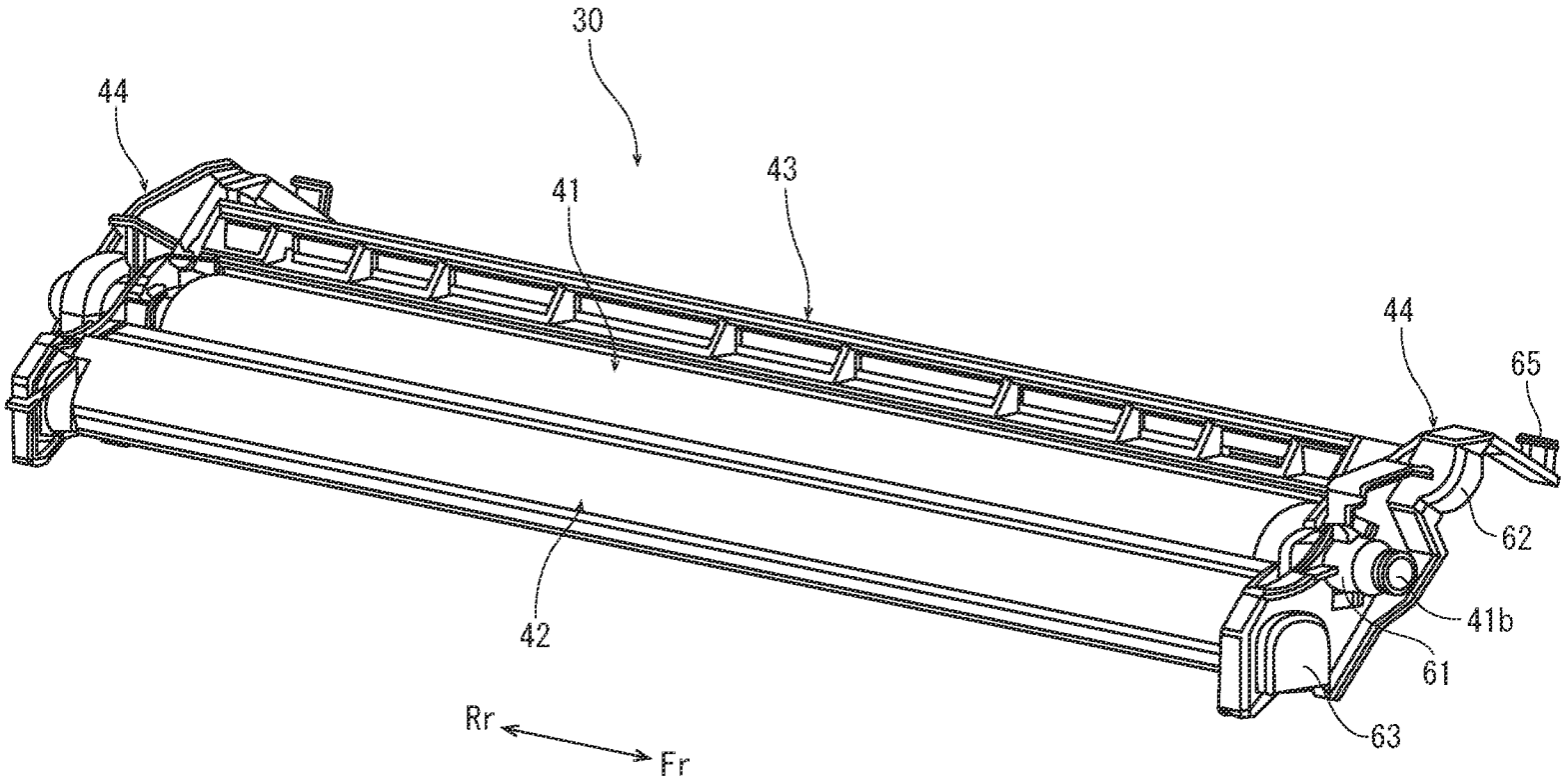
FIG. 2 is a perspective view showing a secondary transfer unit according to one embodiment of the present disclosure.

Next, the secondary transfer unit 30 will be described with reference to FIG. 2 to FIG. 5. FIG. 2 is a perspective view showing the secondary transfer unit, FIG. 3 is a side view showing the secondary transfer unit, FIG. 4 is a front sectional view showing the secondary transfer unit and FIG. 5 is a perspective view showing a holder and a guide.

Figure 3:
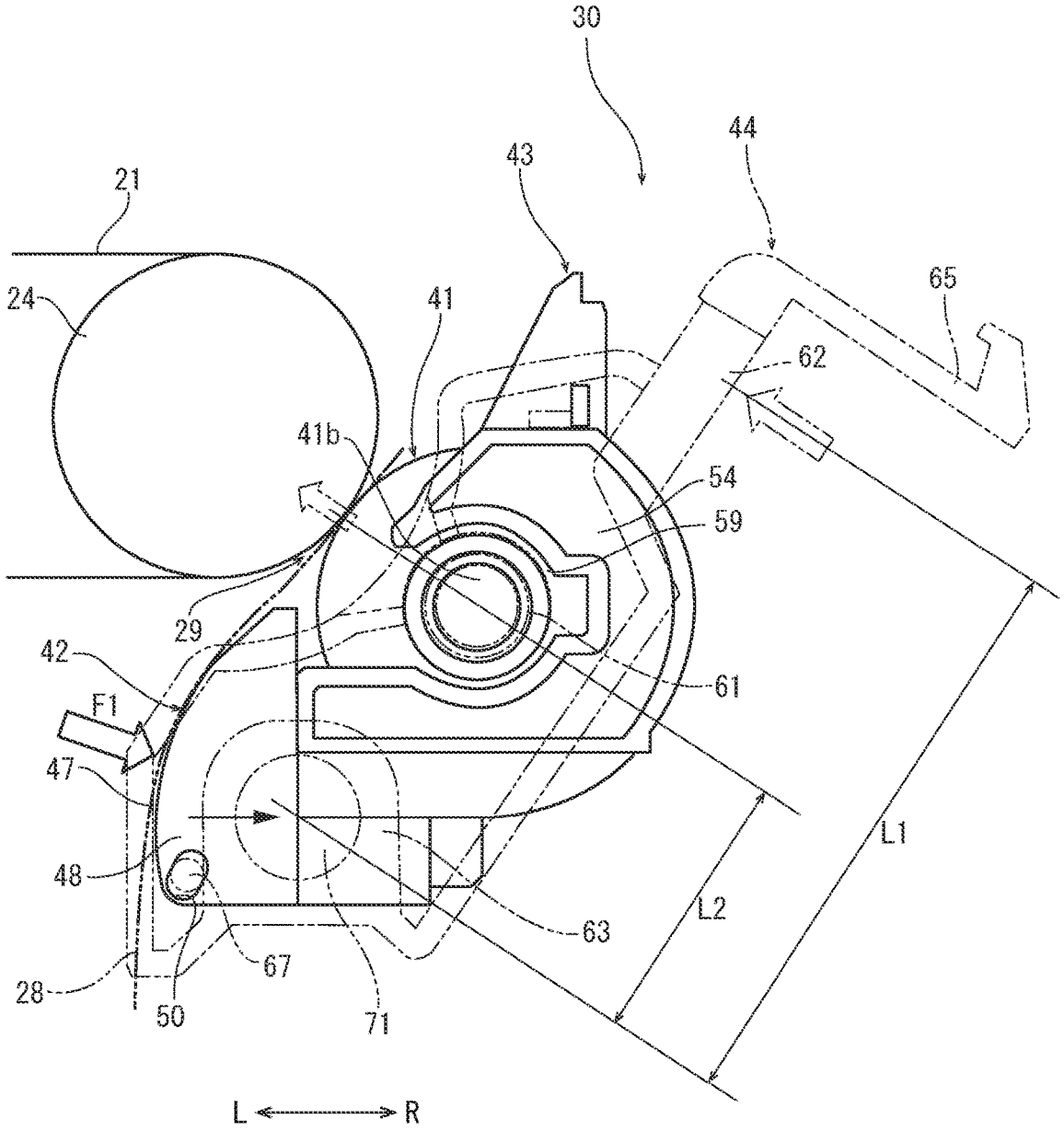
FIG. 3 is a side sectional view showing the secondary transfer unit according to the embodiment of the present disclosure.
Figure 4:
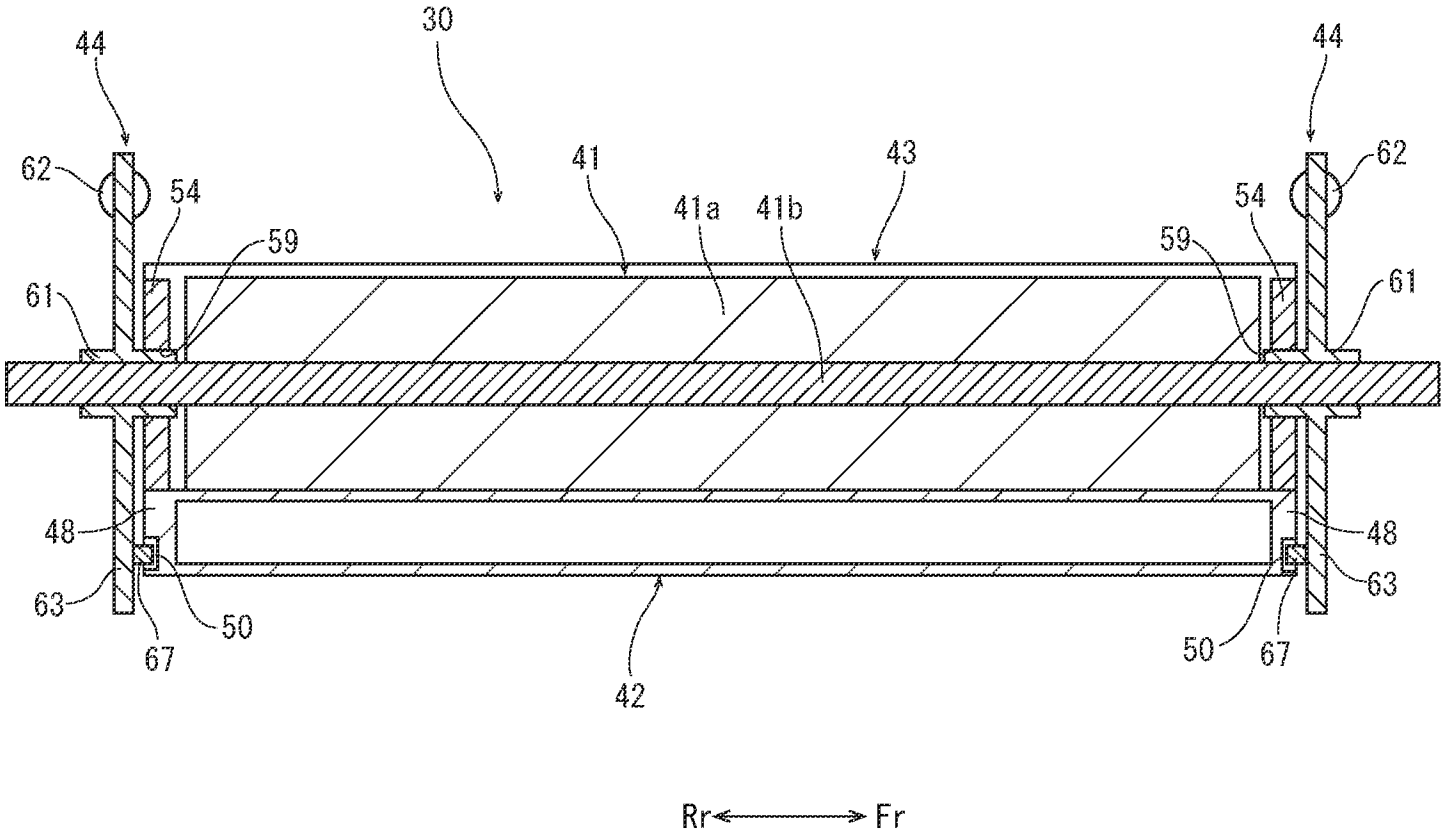
FIG. 4 is a front sectional view showing the secondary transfer unit according to the embodiment of the present disclosure.
Figure 5:
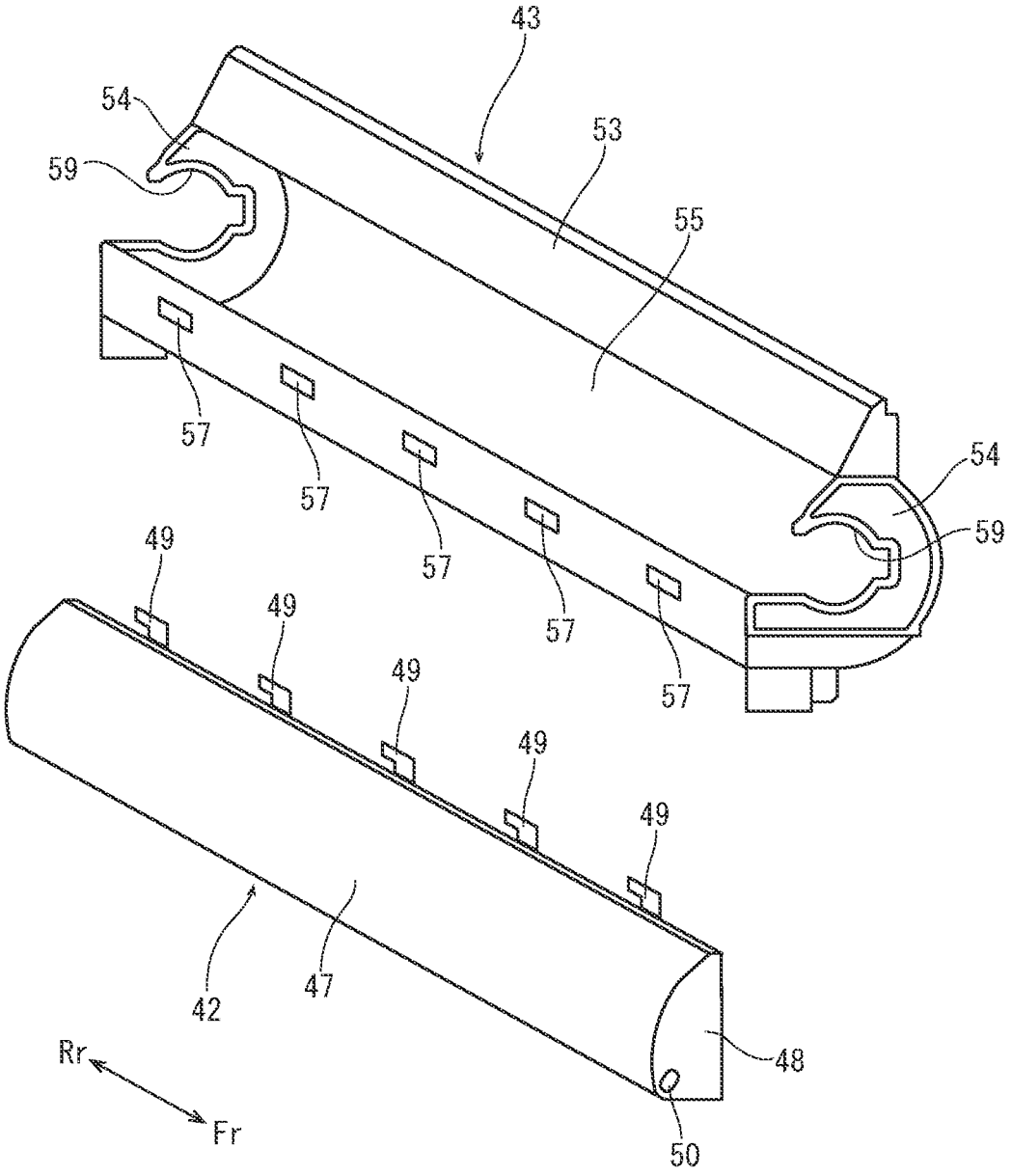
FIG. 5 is a perspective view showing a guide and a holder in the secondary transfer unit according to the embodiment of the present disclosure.

As shown in FIG. 2 to FIG. 4, the secondary transfer unit 30 includes a transfer roller 41, a guide 42, a holder 43 and a pair of levers 44. The transfer roller 41 is configured to be pressed against the intermediate transferring belt 21 to form the secondary transferring nip 29. The guide 42 is disposed at the upstream side of the secondary transferring nip 29 in the conveying direction. The holder 43 supports the transfer roller 41 and the guide 42. The pair of levers 44 is configured to press the transfer roller 41 against the intermediate transferring belt 21.

The transfer roller 41 has a roller body 41*a* and a rotating shaft 41*b*. The roller body 41*a* is made of electrical conductive elastic material. The transfer roller 41 is electrically connected to a transfer bias power source. When the full color toner image transferred on the intermediate transferring belt 21 is transferred on the sheet S at the secondary transferring nip 29, a predetermined bias voltage is applied to the transfer roller 41.

The guide 42 has a guide plate 47 facing the conveying path 28 and a side plate 48 provided on both ends of the guide plate 47 in a width direction (the front-rear direction) perpendicular to the conveying direction. As shown in FIG. 3, the guide plate 47 is formed so as to curve in a right upper oblique direction along the conveying path 28. As shown in FIG. 5, along the downstream side end portion of the guide plate 47 in the conveying direction, a plurality of hook pieces 49 are formed. Each side plate 48 has a long hole 50 that is a hole as an example of an engaged part. The long hole 50 is located at the upstream side end portion (the left lower corner) of the side plate 48 in the conveying direction. The long hole 50 is substantially parallel with the conveying direction along the guide plate 47.

As shown in FIG. 5, the holder 43 has a storage part 53 having an arc shaped side section and shaft supporting parts 54 provided on both ends of the storage part 53 in the width direction. The storage part 53 and the shaft supporting parts 54 form a recess 55 in which the transfer roller 41 can be stored. Along the upstream side end portion of the storage part 53 in the conveying direction, a plurality of engagement holes 57 capable of engaging with the plurality of hook pieces 49 are formed. By engaging the hook pieces 49 with the engagement holes 57, the guide 42 is attached to the holder 43 at the upstream side of the recess 55 in which the transfer roller 41 is stored, in the conveying direction.

Each shaft supporting part 54 has a bearing opening 59 configured to support one end portion of the rotating shaft 41*b* of the transfer roller 41 in a rotatable manner. The bearing opening 59 has a diameter larger than a diameter of the rotating shaft 41*b* of the transfer roller 41. The bearing opening 59 is formed by cutting a part of a side edge of the shaft supporting part 54 inward.

As shown in FIG. 2 to FIG. 4, each of the pair of levers 44 has a bearing part 61, a turning fulcrum part 63, a spring receiving part 62 and a hook part 65. The turning fulcrum part 63 is located on one side (the upstream side in the conveying direction) of the bearing part 61, and the spring receiving part 62 and the hook part 65 are located on the other side (the downstream side in the conveying direction) of the bearing part 61. The bearing part 61 is configured to support the one end portion of the rotating shaft 41*b* of the transfer roller 41 in a rotatable manner. The turning fulcrum part 63 is configured to be supported by the conveying unit 9 in a turnable manner, as described later. The spring receiving part 62 is configured to come in contact with one end of a coil spring provided on the conveying unit 9. The hook part 65 is configured to be engaged with the conveying unit 9.

The bearing part 61 is formed into a cylindrical shape. Through the bearing part 61, the one end portion of the rotating shaft 41*b* of the transfer roller 41 is passed. In addition, the bearing part 61 is configured to be passed through the bearing opening 59 of the shaft supporting part 54 of the holder 43.

The turning fulcrum part 63 is formed into a recess having an inverted U-shape and recessed outward from an inner face of the lever 44, as shown in FIG. 2. An inner face and a lower face of the turning fulcrum part 63 are opened.

The spring receiving part 62 is formed into a circular recess. The hook part 65 is located at the tip portion further separated from the bearing part 61 than the spring receiving part 62.

On the inner face of the lever 44, a pin 67 is stood at a position further separated away from the bearing part 61 than the turning fulcrum part 63. The pin 67 is an example of an engagement part capable of being fitted into the long hole 50 of the guide 42.

In the secondary transfer unit 30 having the above described configuration, the both end portions of the rotating shaft 41*b* of the transfer roller 41 are passed through the bearing parts 61 of the levers 44. The bearing parts 61 through which the end portions of the rotating shaft 41*b* are passed are supported by the bearing openings 59 of the shaft supporting parts 54 of the holder 43 in a rotatable manner. Thereby, as shown in FIG. 2, the transfer roller 41 is stored in the recess 55 of the holder 43, and a part of a circumferential face of the transfer roller 41 exposes from the recess 55. The levers 44 and the holder 43 are rotatable around the rotating shaft 41*b* of the transfer roller 41. In addition, into the long holes 50 of the both side plates 48 of the guide 42, the pins 67 of the levers 44 are fitted. As described above, because the long hole 50 is substantially parallel with the conveying direction along the guide plate 47, the pin 67 fitted into the long hole 50 is allowed to be moved in the longitudinal direction along the conveying direction but is restricted from being moved in the lateral direction perpendicular to the conveying direction.

Figure 6:
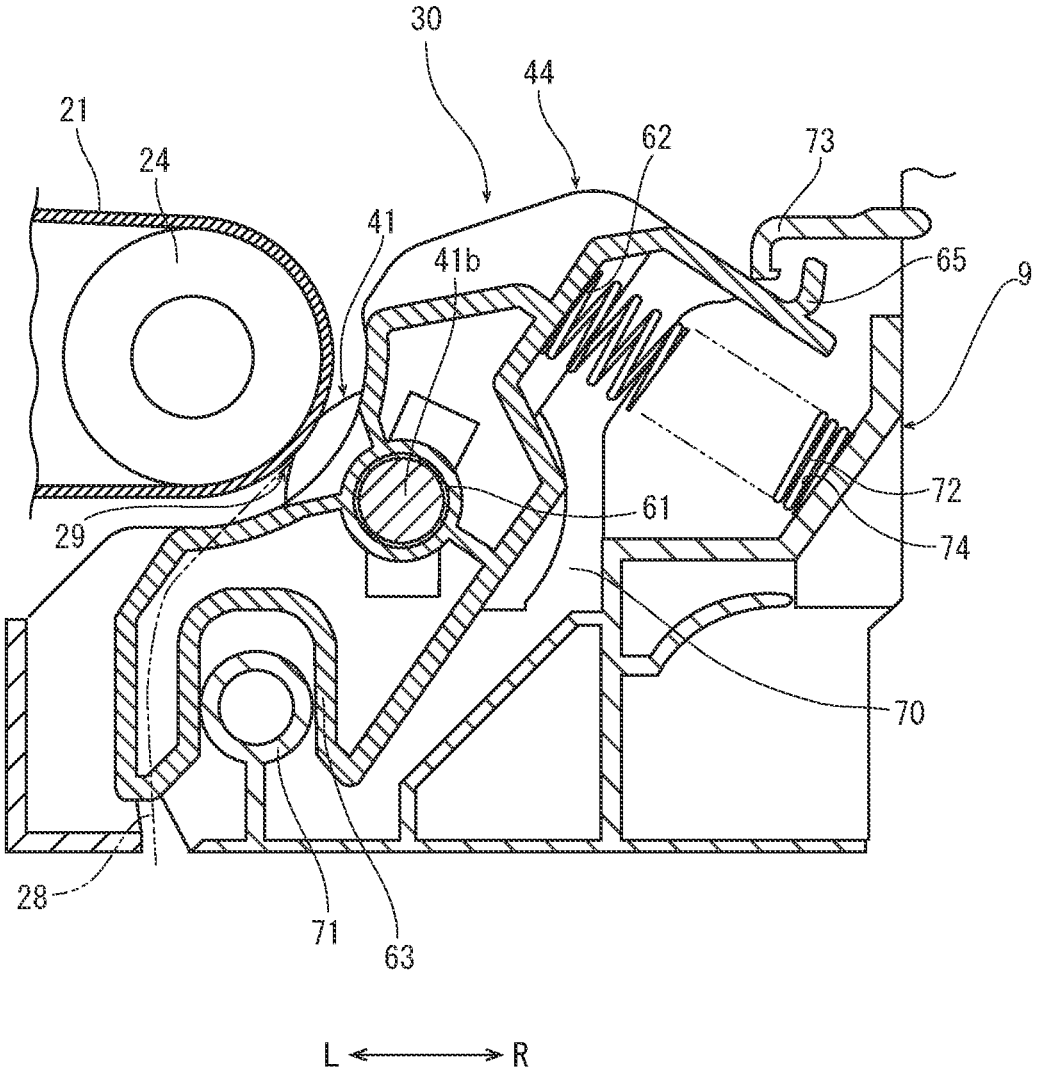
FIG. 6 is a side sectional side view showing a storage recess in which the secondary transfer unit is stored, in the color printer according to the embodiment of the present disclosure.

The secondary transfer unit 30 is supported by a storage recess 70 of the conveying unit 9. The storage recess 70 will be described with reference to FIG. 6. FIG. 6 is s side sectional view showing the storage recess.

The storage recess 70 is recessed inward from the conveying path 28. At each end portion of the storage recess 70 in the width direction, a boss 71, a spring receiving part 74 and an engagement part 73 are formed. The boss 71 is an example of a supporting shaft which supports the lever 44 in a turnable manner. The boss 71 is stood at a left lower corner of the end portion of the storage recess 70 in parallel with the rotating shaft 41*b* of the transfer roller 41. The spring receiving part 74 is formed at a right upper corner of the end portion of the storage recess 70. The other end of a coil spring 72 is supported by the spring receiving part 74. The coil spring 72 is an example of a biasing member which biases the lever 44. The engagement part 73 is formed above the spring receiving part 74.

By inserting the turning fulcrum parts 63 of the pair of levers 44 onto the bosses 71 of the storage recess 70 from the upper side, the secondary transfer unit 30 is supported by the storage recess 70 in a slidable manner along the bosses 71 in the upper-lower direction and a turnable manner around the bosses 71. Then, when the hook parts 65 of the levers 44 are engaged with the engagement parts 73 of the storage recess 70, the one ends of the coil springs 72 come into pressure contact with the spring receiving parts 62 of the levers 44. The coil springs 72 bias the levers 44 in the counterclockwise direction in FIG. 6. An upward movement of the secondary transfer unit 30 is restricted by the hook parts 65 and the engagement parts 73, and a downward movement of the secondary transfer unit 30 is restricted by the storage recess 70.

When the conveying unit 9 to which the secondary transfer unit 30 is supported is turned in a direction in which the conveying path 28 is formed, the transfer roller 41 faces the drive roller 24 of the intermediate transfer unit 13. In addition, the levers 44 which are biased in the counterclockwise direction in FIG. 6 by the coil springs 72 press the rotating shaft 41*b* of the transfer roller 41, and then the transfer roller 41 is pressed against the intermediate transferring belt 21. Thereby, as shown in FIG. 3, the secondary transferring nip 29 is formed between the intermediate transferring belt 21 and the transfer roller 41. A transfer pressure at the secondary transferring nip 29 is defined by a fulcrum ratio of a distance L1 between centers of the boss 71 and the spring receiving part 62 to a distance L2 between centers of the boss 71 and the rotating shaft 41*b*. A turning angle of the lever 44 is defined by a nip amount of the secondary transferring nip 29.

The sheet S conveyed from the sheet feeding cassette 3 along the conveying path 28 is guided to the secondary transferring nip 29 while curved along the guide plate 47 of the guide 42. Then, at the secondary transferring nip 29, the toner image is transferred to the sheet S from the intermediate transferring belt 21.

As shown in FIG. 3, in a case where the conveyed sheet S has a strong stiffness, like a thick paper, when the sheet S curves along the guide plate 47 of the guide 42, the guide plate 47 receives a load F1 from the sheet S. The load F1 is transmitted from side edges of the long holes 50 of the guide 42 through the pins 67 fitted into the long holes 50 to the pair of levers 44. Because the pins 67 and the long holes 50 are located between the guide plate 47 and the turning fulcrum part 63, the load F1 transmitted to the pair of levers 44 is applied to the bosses 71 by which the turning fulcrum parts 63 are supported. Because a direction of the load F1 applied to the guide plate 47 is parallel with the lateral direction of the long holes 50, the pins 67 is restricted from being moved in the long holes 50 so that the load F1 can be directly transmitted to the levers 44.

Figure 7:
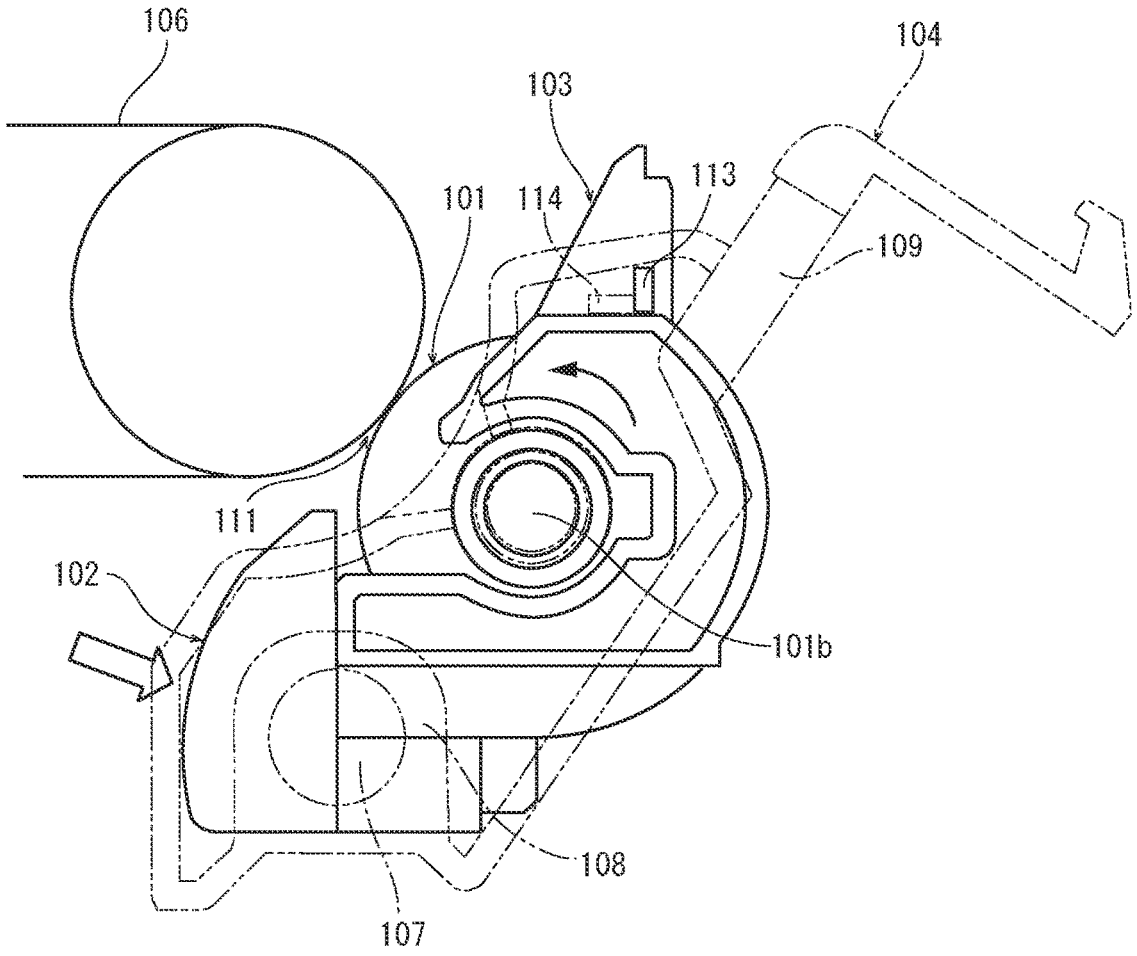
FIG. 7 is a side sectional view showing a conventional secondary transfer unit.

As described above with reference to FIG. 7, in the conventional example, the load applied to the guide 102 from the sheet S is transmitted to the holder 103, and a moment for turning the holder 103 is generated.

However, in the present embodiment, as described above, the load F1 applied to the guide 42 from the sheet S is directly applied to the levers 44 without through the holder 43, and then applied to the bosses 71 from the levers 44. Thereby, the guide 42 is hardly affected by mounting backlash and rigidity of each member, and is hardly displaced accordingly. Thus, it becomes possible to guide the sheet S to the secondary transferring nip 29 with a constant conveying posture even if the sheet S has a strong stiffness.

As described above, in the color printer 1 according to the present disclosure, the load applied to the guide 42 from the sheet S is directly applied to the levers 44 through the pins 67 and the long holes 50 without being affected by the rigidity and the mounting backrush of the holder 43. Thus, the guide 42 is hardly displaced so that the sheet S can be guided to the secondary transferring nip 29 stably with a constant conveying posture even if the sheet S has a strong stiffness. In addition, increasing in rigidity of each member is eliminated and increasing in cost is accordingly eliminated.

Additionally, the load applied to the levers 44 is received by the bosses 71 of the conveying unit 9 so that the rigidity and the mounting backrush of the levers 44 have little effect on the guide 42. Accordingly, the displacement of the guide 42 can be restricted more surely.

Additionally, by a simple configuration in which the long holes 50 and the pins 67 which are engaged with each other are respectively formed on the guide 42 and the levers 44, the turning of the guide 42 and the levers 44 can be prevented surely. In addition, the pins 67 in the long holes 50 are allowed to be moved in the longitudinal direction but restricted from being moved in the lateral direction. Because the direction of the load F1 applied to the guide plate 47 from the sheet S is parallel with the lateral direction of the long holes 50, the pins 67 are restricted from being moved in the long holes 50 so that the load F1 can be directly transferred to the levers 44.

If the long holes 50 and the pins 67 may have dimension errors, the guide 42 may turn around the rotating shaft 41*b* until the side edge of the long holes 50 are engaged with the pins 67 of the levers 44 (until the guide 42 is prevented from being turned). Because the long holes 50 are located at the left lower corners of the side plates 48 of the guide 42, a distance between the long hole 50 and the axial center of the rotating shaft 41*b* becomes the farthest in a side view of the guide 42 and the holder 43. Thus, a turning angle of the guide 42 until the guide 42 is restricted from being turned can be made to be small so that the displacement of the guide 42 can be restricted.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A transfer unit comprising:

a transfer roller configured to be pressed against an image carrier to form a transferring nip and to transfer a toner image from the image carrier to a sheet at the transferring nip;

a guide configured to guide the sheet along a conveying direction toward the transferring nip;

a holder configured to support a rotating shaft of the transfer roller in a rotatable manner and to support the guide; and a lever configured to support the holder in a turnable manner around the rotating shaft so as to press the transfer roller against the image carrier, wherein the lever includes a pin, the guide includes a hole into which the pin is fitted, the hole being configured to allow the pin to move along the conveying direction and to restrict the pin from being moved in a direction perpendicular to the conveying direction, and the pin and the hole are located at the farthest positions from an axial center of the rotating shaft on side faces of the lever and the guide, respectively, wherein an engagement of the pin with the hole prevents a turning of the guide with respect to the lever.

2. The transfer unit according to claim 1, wherein the hole is located at an upstream side end portion of the side face of the guide in the sheet conveying direction.

3. An image forming apparatus comprising:

a conveying unit supported by an apparatus main body in a tunable manner and configured to form a sheet conveying path with the apparatus main body; and a transfer unit according to claim 1, wherein the conveying unit includes a storage recess in which the transfer unit is stored, the storage recess has:

a supporting shaft to which the lever is supported in a tunable manner; and a biasing member configured to bias the lever in a direction in which the transfer roller is pressed against the image carrier when the conveying unit is turned in a direction in which the conveying path is formed.

4. The image forming apparatus according to claim 3, wherein the hole and the pin are located between a guide plate formed on the guide so as to face the conveying path, and the supporting shaft of the conveying unit.

* * * * *